United States Patent [19]

Choma

[11] 4,275,656

[45] Jun. 30, 1981

[54] BUBBLE PRINTING METHOD

[75] Inventor: John R. Choma, Cambridge, Mass.

[73] Assignees: Charles J. Choma; Lena G. Choma, both of Plainville, Mass.

[21] Appl. No.: 11,784

[22] Filed: Feb. 14, 1979

[51] Int. Cl.[3] ..... B41M 1/20; B41M 1/42; B05D 1/34; B05D 5/06

[52] U.S. Cl. ..... 101/211; 101/1; 101/426; 118/506; 427/262; 427/288; 46/8

[58] Field of Search ..... 101/211, 1, 426; 8/14; 427/262, 288; 118/506; 46/6, 7, 8

[56] References Cited

U.S. PATENT DOCUMENTS

| | | | |
|---|---|---|---|
| 1,205,123 | 11/1916 | Bradway | 46/6 |
| 2,716,826 | 9/1955 | Hubner | 101/1 |
| 3,042,573 | 7/1962 | Roberts | 427/296 |
| 3,111,796 | 11/1963 | Meissner | 118/506 |
| 3,211,088 | 10/1965 | Haiman | 101/1 |
| 3,443,337 | 5/1969 | Ehrlich | 46/6 |
| 3,584,571 | 6/1971 | Schmoll | 101/1 |
| 3,995,581 | 12/1976 | Smeida | 101/211 |
| 4,023,526 | 5/1972 | Ashmus | 427/244 |
| 4,146,362 | 3/1979 | Nichols | 8/14 |
| 4,162,342 | 7/1979 | Schwartz | 427/262 |

FOREIGN PATENT DOCUMENTS

| | | | |
|---|---|---|---|
| 841959 | 5/1970 | Canada | 101/211 |

*Primary Examiner*—Clyde I. Coughenour
*Attorney, Agent, or Firm*—Schiller & Pandiscio

[57] ABSTRACT

A method for printing on textiles and the like and which employs a substantially ordered array of bubbles, each individually formed and colored, to carry the colorant to the surface being printed and to form the desired pattern on the surface.

11 Claims, 14 Drawing Figures

BUBBLE PRINTING METHOD

BACKGROUND OF THE INVENTION

This invention relates to printing, and more particularly to printing designs and patterns on webs and other surfaces.

The application of designs and patterns, particularly in color, to surfaces such as webs, typified by textiles, is an art which had its beginnings in prehistory and which embraces a large number of different techniques. Examples of these techniques include the direct manipulation of the web to produce the pattern, as in tie dying, the use of stencils as in silk screen, printing plates, as in intaglio, letter-press, and planographic printing, and the direct manipulation of the coloring matter itself, as by hand painting and jet printing.

Typically, if a multi-colored design is to be produced, these techniques require that two or more colors be applied in succession. In terms of apparatus, this requires either that the device used to apply a single color be cleaned and otherwise prepared between each color, or that a multiplicity of devices, one for each color be used in succession. Generally, all successive patterns must be applied in registration, and, in the case of stencils and printing plates, a separate stencil or plate must be prepared for each color to be applied in a different pattern.

Consideration of the foregoing indicates a number of potential limitations in apparatus designed for volume production of printed designs and patterns. Registration may be difficult to insure, due to the dimensional instability of the web. Registration is particularly critical at the boundary line separating colors, and lack of registration may prevent printing patterns with fine boundaries. Practical considerations place limits on the number of separate colors which may be applied, and while this limitation to the pallette may be of little consequence in some circumstances, it can severely limit the designs which can be reproduced in other cases. In this connection, it should be noted that, for the majority of these techniques, the number of gradations in the quantity of coloring matter presented to the web in any single application of color is generally small, and that three- or four-color processes in these cases results in a very limited selection of hue, saturation, and lightness in the resulting print.

Clearly, a method of printing which permits the simultaneous application of a large number of colors to a surface, without the need of stencils or plates, has considerable application.

OBJECTS OF THE INVENTION

Accordingly, it is an object of the present invention to provide a method of multi-color printing wherein a multiplicity of colored patterns may be simultaneously, rather than sequentially, imprinted on a surface.

Further, it is an object of the present invention to provide an apparatus for color printing which can readily accept an extended palette of colors to be imprinted and a number of gradations in tone of each color.

Additionally, it is an object of the present invention to provide a system of printing which, simultaneously with the printing of multi-colored patterns, can provide fine, contrasting, boundary lines, in perfect register, between patterns.

Yet another object of this invention is to provide printing apparatus which does not require the preparation of conventional stencils or plates and which contacts the surface being printed with minimal mechanical force.

SUMMARY OF THE INVENTION

These and other objects are realized in the present invention in which a substantially ordered array of bubbles, each individually formed and colored, is used to transfer the colorant to the surface being printed, thereby forming the desired pattern on the surface.

The bubbles are formed by an ordered array of bubble generators placed nearly in contact with the surface to be printed. Each generator is a chamber into which controlled amounts of liquid and gas can be injected on command. The chambers each have a small aperture facing the surface to be printed.

The printing process is initiated by metering a mix composed of a carrier liquid, agents to control surface tension, and a dye, pigment, or other coloring matter, into each generator. The mix is so dispensed in each generator as to spread, covering the aperture with a thin film. Gas is then admitted into the generators, in a synchronized, short, burst, creating an array of bubbles, one for each generator. The bubble array is expanded or placed into contact with the surface to be printed, where the array adheres through surface tension, the surface having been pre-treated with a wetting agent, if necessary. Color is transferred to the surface to be printed either through the diffusion of the coloring matter from the walls of the individual bubbles, or through the delibrate, controlled collapse of the bubbles, or both.

As each bubble is individually colored, it will be appreciated that the generation of the ordered array of bubbles is, in effect, the production of a multi-colored printing plate which, with minimal mechanical force, imprints the surface to be printed with a complex multi-colored pattern in a single impression, although multiple impressions are certainly possible.

It will be further appreciated that the palette of colors which can be accommodated, and the gradation in tone for each color, can be provided for in the preparation of the mix for each bubble, and is not governed by consideration of the number of impressions.

The size of the individual bubbles may be varied by altering the amount of gas used to form the bubbles. If the bubbles are sufficiently large, a tightly packed array with hexagonal cells is produced. Additional coloring matter may be dispensed to selected locations on the top of this tightly packed array of bubbles by a secondary set of dispensers. This additional color will flow, by capillary action, through the interstices between adjacent bubbles, thereby printing boundary lines.

Other objects of the present invention will in part appear obvious and will in part appear hereinafter. The invention accordingly comprises the process, and the apparatus possessing characteristic features exemplified in the following detailed disclosure, the novel features of which are set forth in the appended claims.

BRIEF DESCRIPTION OF THE DRAWINGS

For a fuller understanding of the nature and objects of the present invention, reference should be had to the following detailed description taken in connection with the accompanying drawings wherein.

DETAILED DESCRIPTION OF THE DRAWINGS

Figure 1B:
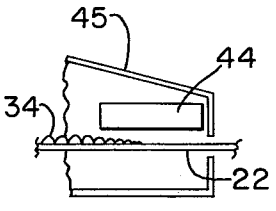
FIG. 1B is a partial diagrammatic view schematically illustrating an alternative arrangement of another portion of the apparatus of FIG. 1.
Figure 1:
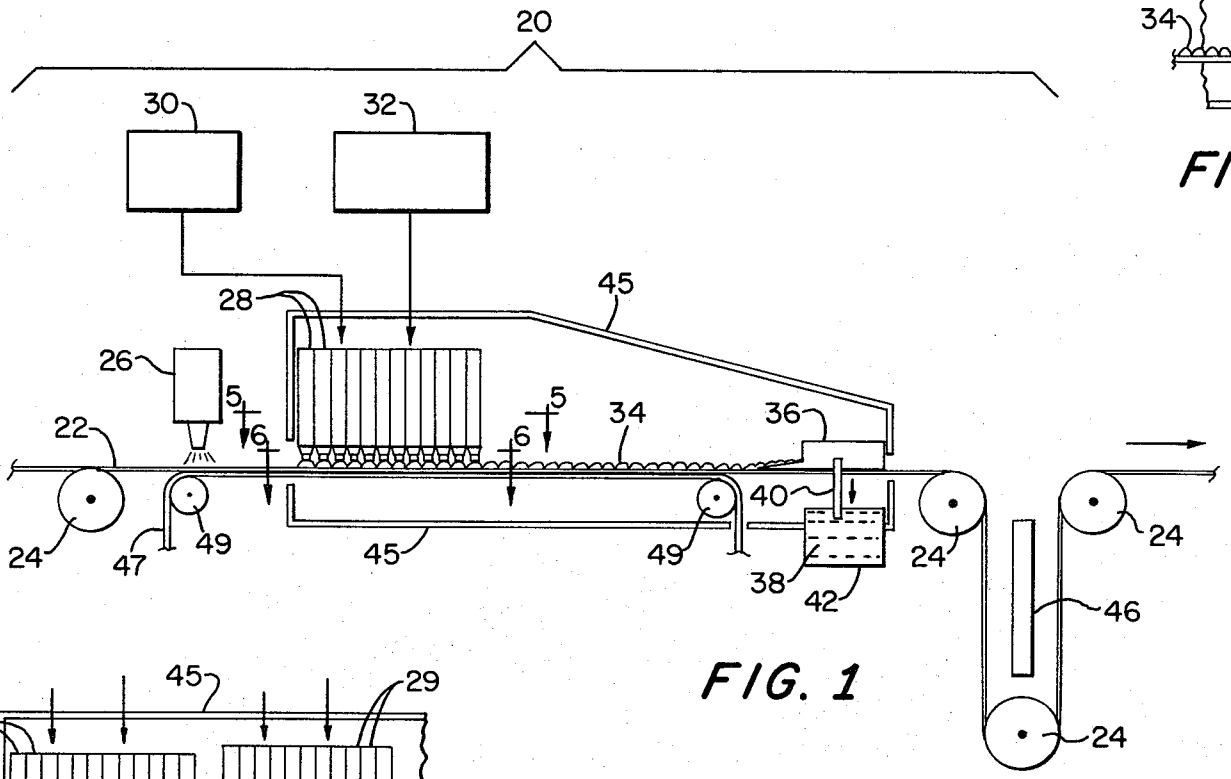
FIG. 1 is a diagrammatic view schematically illustrating an apparatus made in accordance with the principles of the invention.

Referring to FIG. 1, there is shown an apparatus made in accordance with the principles of the present invention, which, in a preferred embodiment is in the form of a web-fed press 20. Substrate 22, in the form of a web, is supported and propelled, from left to right in the Figure, by rollers 24. Substrate 22 may be any of a number of various materials, such as woven, knitted, felted, or other textiles, elastomeric or polymeric materials, and the like, and should not be considered to be limited to any particular material. Similary, as will be apparent to those skilled in the art of printing, the principles of the present invention can be applied to sheet- as well as web-, fed material, and, indeed, substrate 22 may be any substantially flat surface.

As will be described hereinafter, the novel printing process of the present invention depends upon the adherence of bubbles to substrate 22 and the flow of coloring matter from and around these bubbles onto the substrate. To insure this adherence and flow, it may be necessary to condition substrate 22 with an appropriate wetting agent, selected according to rules to be described hereinafter, as by wetting apparatus 26. Wetting apparatus 26 may be a spray, as pictured, or any of a number of other equipments for applying a thin film to substrate 22, such as baths, foams, rollers and the like.

Bubble generators 28 are mounted above and clear of substrate 22. Connected to generators 28 are supply means 30 and 32 which supply compressed gas and liquid, respectively, to generators 28. The gas supplied to generators 28 by supply means 30 may be compressed air, carbon dioxide, nitrogen, or the like. The liquid supplied to generators 28 by supply means 32 is a mix composed of a carrier liquid, such as water, an agent to raise the surface tension of the liquid, such as a sodium or potassium salt of a fatty acid, and a dye, pigment, or other coloring matter, as desired. The liquid may also, although not necessarily, contain other agents to control surface tension, pH, and the like, to provide for printing effects which will be described hereinafter.

Generators 28 combine the gas and liquid from supply means 30 and 32 to form an ordered array of comparatively large (i.e., on the order of between about 3 and 50 mm diameter) bubbles 34 which are blown or otherwise deposited directly from the generators onto substrate 22. The clearance between generators 28 and substrate 22 is chosen to accommodate this array without disturbing it as substrate 22 moves under generators 28. Each bubble 34 is in the form of a thin continuous film of the liquid inflated with the compressed gas.

Figure 1A:
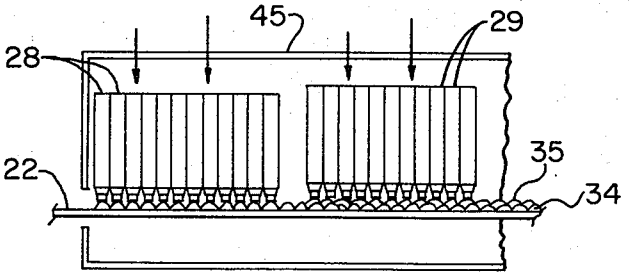
FIG. 1A is a partial diagrammatic view schematically illustrating an alternative arrangement of a portion of the apparatus of FIG. 1.

As will be described hereinafter, for some purposes a plurality of bubble arrays, one deposited on another, may be desired. As may be seen by reference to FIG. 1A, this may be accomplished by the use of a plurality of arrays of generators, as 28 and 29, located longitudinally along the direction of motion of substrate 22. The latter array of generators 29, is elevated about the substrate somewhat more than the earlier array of generators 28, in order to clear bubbles 34 generated by generators 28. The array of generators 29 is smaller in both length and width than the array of generators 28 by one row and one column, and thus it is displaced laterally a distance equal to the radius of one generator. Generators 29 deposit an array of bubbles 35 on top of the array of bubbles 34 formed by generators 28; in all other respects the generators and bubbles are similar.

Bubble collapse means 36 is provided to remove bubbles 34 from substrate 22 after printing. Excess liquid 38, sometimes but not necessarily resulting from the destruction of bubbles 34, may be drained through conduit 40 to reservoir 42. Alternatively, excess liquid 38, which is primarily carrier liquid, may be removed by evaporation, the heat for this being provided by a radiant heater 44, shown in FIG. 18.

Returning to FIG. 1, there may be seen enclosure 45 which surrounds substrate 22, generators 28, and bubble collapse means 36 (or the alternative radiant heater 44 of FIG. 1B). Enclosure 45 is in the form of a box, with openings to permit substrate 22 and padding 47 (described hereinafter) to pass through and to accept the necessary fluid and power lines for the generators, bubble collapse means, and so forth; it is provided to control atmospheric disturbances, dust, humidity, and air temperature during the printing process. FIG. 1 shows a radiant heater 46, provided to dry substrate 22 after printing.

In some cases, it may be necessary to remove excess moisture from substrate 22 during printing. To this end, padding 47, in the form of a moving web, is held in contact with the under surface of substrate 22 by rollers 49 from a location just prior to wetting apparatus 26 to one just prior to bubble collapse means 36. Padding 47 is made of an absorbent material, is as wide or slightly wider than substrate 22, and is moved by rollers 49 at the same velocity as rollers 24 propel substrate 22.

Figure 2:
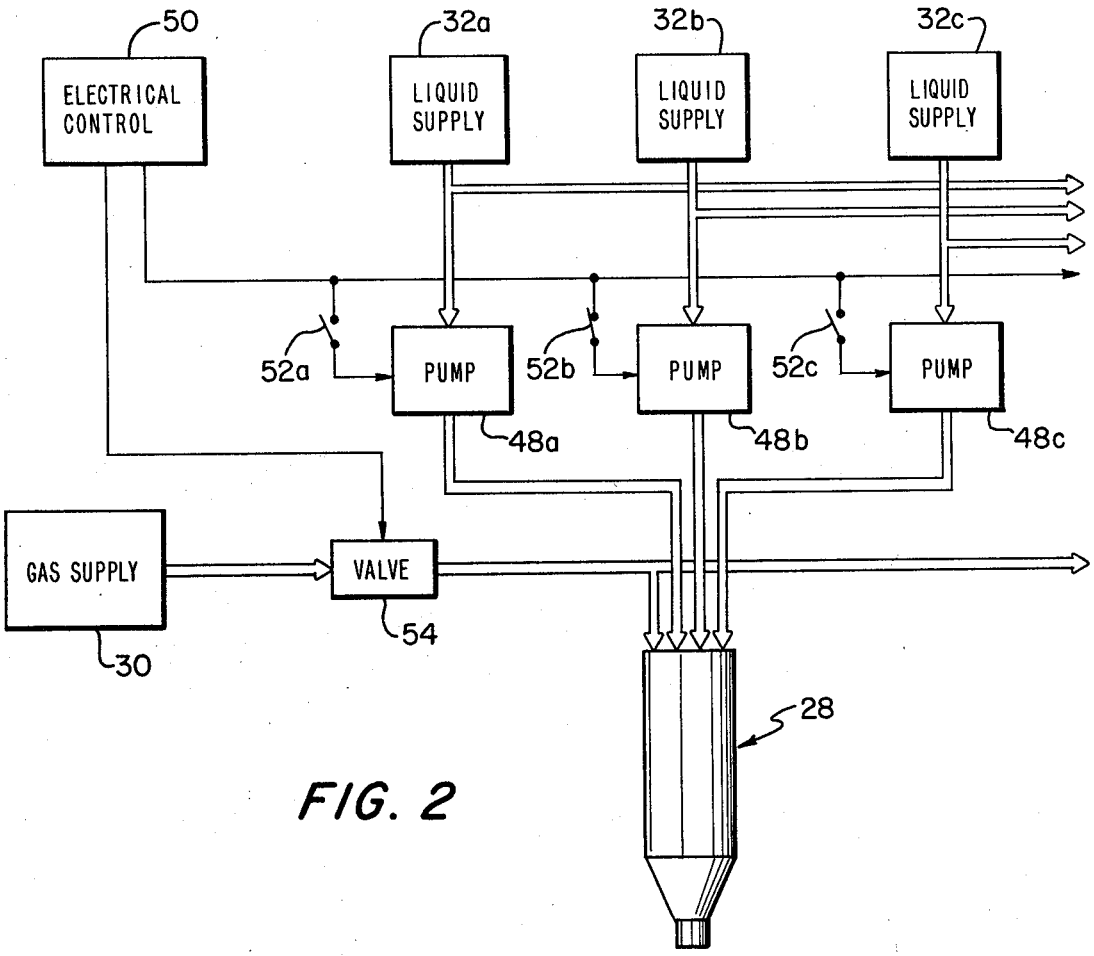
FIG. 2 is a partial schematic illustrating the fluid control system suitable for use with a single bubble generator 28 of FIG. 1.

Turning now to FIG. 2, there is shown in greater detail a preferred means for supplying individual bubble generators 28 with gas and liquid. Gas and liquid supply conduits are shown as double lines, while electrical paths are shown as single lines. A plurality of supply means 32*a*, 32*b* and 32*c*, each of which may be a simple reservoir, provide different colored liquid through individual corresponding metering pumps 48*a*, 48*b* and 48*c* to bubble generator 28. Each bubble generator is supplied with a set of metering pumps, one pump of each set corresponding to each of the supply means. Metering pumps 48*a*, 48*b* and 48*c* are electrically activated by a signal from controller 50. A plurality of switches 52*a*, 52*b* and 52*c* coupled to respective ones of metering pumps 48*a*, 48*b* and 48*c* are interposed between controller 50 and the metering pumps. Gas supply means 30, which may be a compressor or a gas cylinder, provides compressed gas to all bubble generators 28 through a solenoid valve, 54, which is activated by a second signal from controller 50.

Controller 50 may be any of a number of electromechanical control devices capable of providing a plurality of electrical signals of selectable duration and separation, and may be activated by such means as an internal timer synchronized with the motion of substrate 22, a photoelectric relay disposed to detect the location of the last formed bubble array on the moving substrate, a manually operable push button coupled to an electrical source, or the like.

Figure 3:
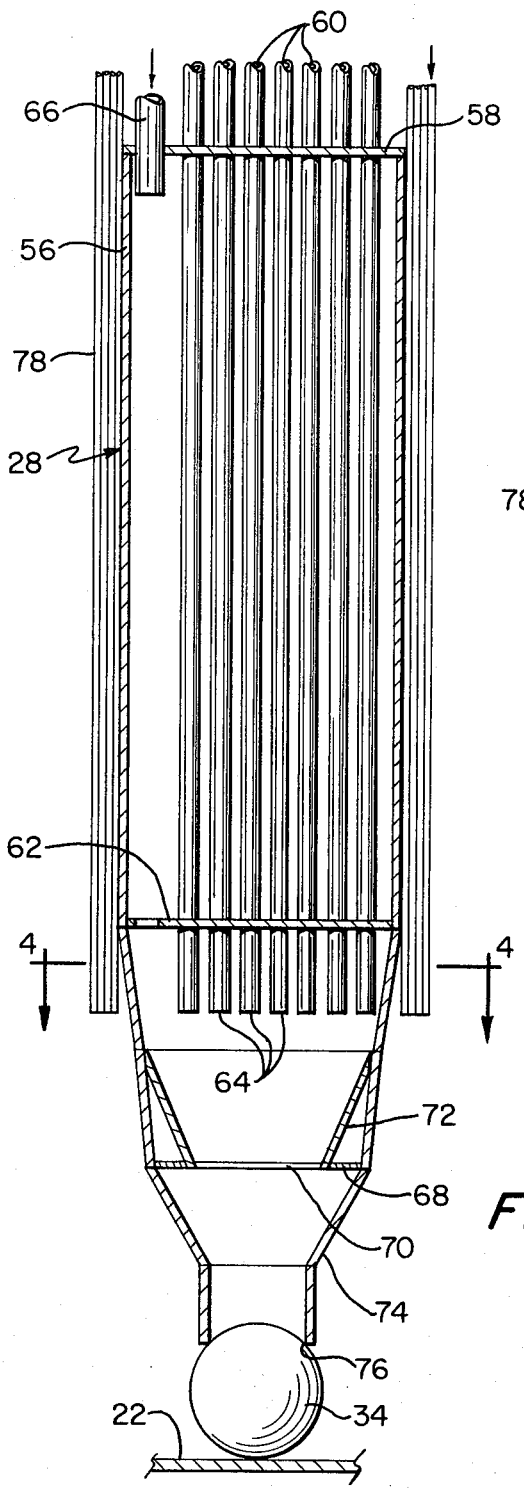
FIG. 3 is a vertical cross-sectional view of a bubble generator and secondary disperser suitable for use with the apparatus of FIG. 1.
Figure 4:
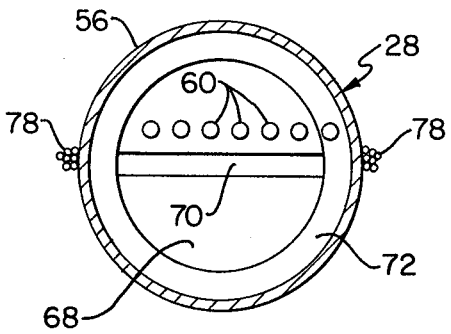
FIG. 4 is a horizontal cross-sectional view of the generator of FIG. 3, taken along the lines 4—4 of FIG. 3.

Referring now to FIGS. 3 and 4, there may be seen an individual bubble generator 28 suitable for use in connection with the present invention. Bubble generator 28 is substantially in the form of a hollow cylinder with side walls 56 and attached top wall 58. Feed tubes 60, disposed eccentrically within the generator, enter the generator through top wall 58 and extend almost the entire height of the cylinder. A perforated plate 62 attached to the interior of side wall 56 supports the lower extremities of feed tubes 60, which terminate in openings 64. The number of feed tubes 60 is chosen to correspond to the number of liquid supply means 32, the other extremity of each feed tube being connected to a different metering pump 48. Gas line 66, which is connected to gas supply means 30 through solenoid valve 54, also communicates to the interior of bubble generator 28 through top wall 58. The exterior surfaces of feed tubes 60 and gas line 66 are sealed to top wall 58 which is in turn sealed to side wall 56.

The lower end of cylinder side wall 56 is closed over and sealed by aperture plate 68, centered in which is aperture 70. Aperture 70 is in the form of a thin slit oriented along a diameter of the cylinder. Extending upward from aperture plate 68, and connected to it and to side wall 56 in the region below openings 64 of feed tubes 60 is tapered section 72. Extending downward from aperture plate 68 is tapered section 74, in the form of a funnel terminating in nozzle 76.

Attached to the exterior of side wall 56 are auxiliary feed tubes 78. In the configuration illustrated, two sets of auxiliary feed tubes are affixed to each bubble generator 28, spaced 180° apart about the periphery of the generator. Auxiliary feed tubes 78 communicate, via their own metering pumps 48, to liquid supply means 32.

A plurality of bubble generators 28 and auxiliary feed tubes 78 may be combined in an array. In a particularly useful array, illustrated in FIG. 5, the generators are in staggered rows and columns, each generator (except the peripheral ones) being in contact with and surrounded by six other generators. Auxiliary feed tubes 78 are so positioned as to occupy the interstices between those adjacent bubble generators 28.

Figure 9:
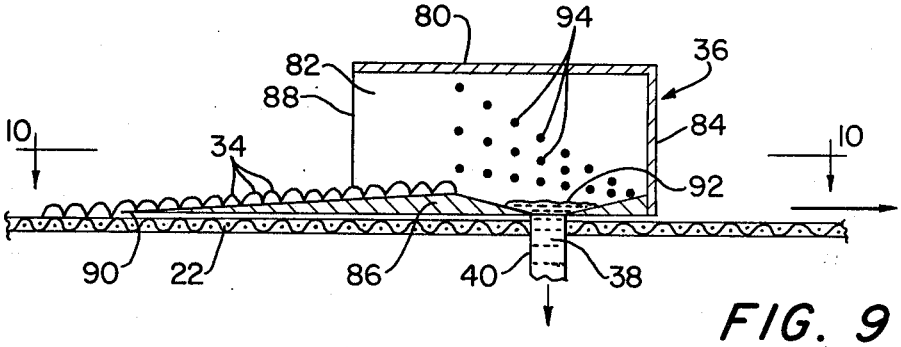
FIG. 9 is a vertical cross-sectional view of an apparatus suitable for the removal of the bubble array, after printing.
Figure 10:
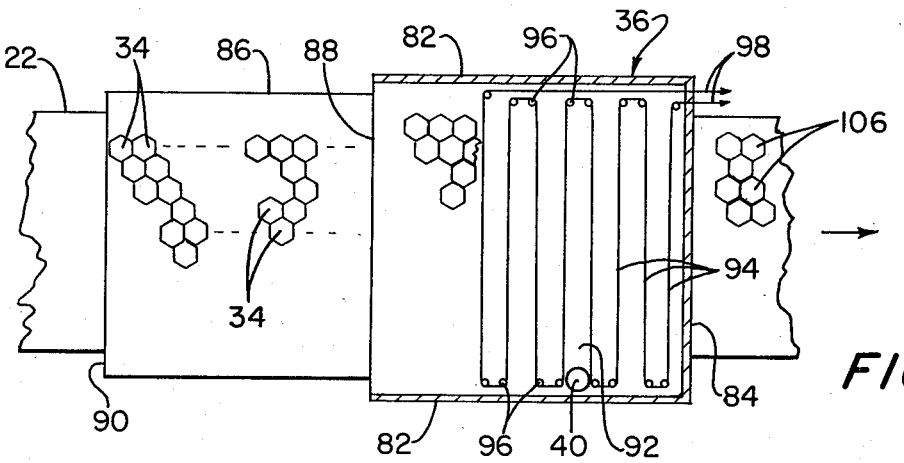
FIG. 10 is a horizontal cross-sectional view, taken along the line 10—10 of FIG. 9.

Referring now to FIGS. 9 and 10, there may be seen bubble collapse means 36 suitable for use with the present invention. The main structure of bubble collapse means 36 is in the form of a substantially rectangular box with top wall 80, side walls 82, back wall 84 and bottom wall 86. The remaining wall of the box is missing, providing opening 88. Collapse means 36 is disposed so that bottom wall 86 is substantially parallel to, and just clear of, substrate 22, and so that opening 88 faces foward, toward bubble generators 28 in the direction opposite the direction of motion of substrate 22. The width of bubble collapse means 36 is chosen to be greater than the width of substrate 22. Bottom wall 86 extends between sidewalls 82 and from backwall 84 forward in the direction of bubble generators 28 through opening 88, providing an extended apron in front of the opening. The forward edge 90 of bottom wall 86 is formed into a thin knife edge which is situated almost in contact with (e.g. within about 1.5 mm of) substrate 22. From forward edge 90, the upper surface of bottom wall 86 slopes upward toward rear wall 84 at a slight angle (i.e. between 2° and 10°). Inside the box, the upper surface of bottom wall 86 reaches a peak, and thereafter first slopes downward and then upward at a moderate angle (i.e., between 10° and 30°), forming a trough 92. The lowermost portion of trough 94 is inclined at a slight angle downward in a direction across the width of substrate 22, and at its low end connects with conduit 40. Located above trough 92 stretching back and forth between sidewalls 82 is a resistance heating element 94 in the form of a nichrome wire supported on insulators 96 attached to sidewalls 82. Heating element 94 is so situated above bottom wall 86 so as to contact any bubbles 34 resting on the bottom wall within trough 92. Electric power is supplied heating element 94 by cable 98.

The operation of web-fed press 20 will now be described. As hereinabove mentioned, substrate 22 may be any of a variety of fabrics; the specific examples of the solution formulations given hereinafter were tested with a substrate 22 of unbleached, mercerized cotton presoaked in a 2% solution of industrial grade sod ash in tap water and then dried.

As depicted in FIG. 1, substrate 22 is propelled from left to right and supported by rollers 24. A continuous supply of dry padding is supplied by and held in contact with the underside of substrate 22, by rollers 49. As the substrate passes wetting apparatus 26, it is sprayed with a solution of a wetting agent. Excess wetting agent is absorbed by padding 47. As an example of the wetting agent, it has been found that a solution of 3 grams soda ash dissolved in 450 ml. distilled water to which has been added 3 ml glycerol, applied at a rate of 0.014 ml per 31 $mm^2$, is satisfactory for use with the mercerized pre-treated cotton substrate and the exemplary bubble solution given hereinafter. After being sprayed with the wetting solution, substrate 22 enters enclosure 45, which excludes dust and drafts and controls the air temperature and humidity about the substrate during the printing process. Substrate 22 next moves under the array of bubble generators 28.

Individual liquid supply means 32, in the form of reservoirs, are filled with a mix of carrier liquid, an agent to raise the surface tension of the liquid, and coloring matter. Satisfactory results have been obtained with a formulation of 40 parts distilled water, 1 part sodium oleate, and 10 parts glycerol to which coloring matter, such as Procion (ICI United States, Inc.) Turquoise MXG, MS-126-77, 31071, B-5736 is added in varying amounts, depending upon the intensity of color desired.

The color pattern of the array of bubbles to be produced is determined by the settings of switches 52 interposed between controller 50 and metering pumps 48. Initiation of controller 50 produces a series of timed electrical pulses, the first of which is transmitted to the drive motors of metering pumps 48 through closed switches 52. Those pumps thus energized deliver a small quantity (i.e., on the order of 0.014 ml) of liquid from the associated liquid supply means 32 through the appropriate feed tube 60 into the associated bubble generators 28. This forces an equally small quantity of liquid out of the opening 64 of feed tube 60, the feed tubes having previously been filled. Due to the eccentric location of the feed tubes, this small quantity of liquid drops onto tapered section 72, flows downward, and spreads to cover aperture 70 with a thin film. A short time after controller 50 has initiated the sequence leading to the formation of this film, the controller generates another electrical signal, this one directed to solenoid valve 54. This releases a small quantity of compressed gas, such as air, from gas supply means 30. This gas is conducted to the interior of bubble generators 28 by gas lines 66. Because generator 28 is a hollow cylinder open to external pressure only through aperture 70, the released compressed gas can reduce its pressure by flowing through this aperture, thereby forming a bubble 34 out of the film covering the aperture. The bubble so formed is forced by gas pressure downward through nozzle 76 and into contact with substrate 22. In the preferred embodiment, the bubbles formed vary from about 3 mm to about 50 mm and are produced with an aperture 70 approximately 1.5 mm wide by 6 mm long and a nozzle 76 approximately 6 mm in diameter, the size of the bubble depending on the quantity of compressed gas released.

Figure 6:
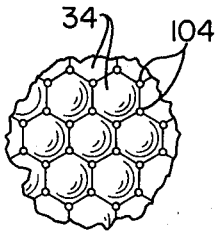
FIG. 6 is a fragmentary top view of the array of bubbles formed by the array of FIG. 5, viewed along the line 6—6 of FIG. 1.
Figure 7:
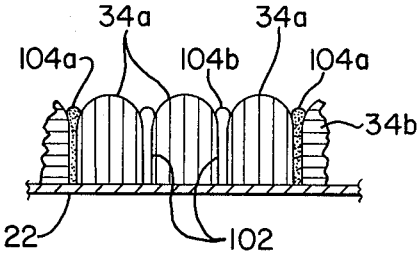
FIG. 7 is a vertical sectional view of the array of bubbles of FIG. 6.

A single bubble 34 resting on substrate 22 distorts, contacting the plane of the substrate in a small circular area. If an aggregate of bubbles are in contact with each other, the contacting walls likewise distort, taking on a form such that the total surface area of the contacting bubbles, including the contacting surface, is a minimum for the total quantity of gas contained within the bubbles. The individual bubbles, where they contact, do not join to form a single wall, but maintain individual walls separated by an interstice of capillary dimensions. The wall segments are all spherical segments, the curvatures of which are governed by the pressure differentials across the wall. As the internal pressure of a bubble is governed by the surface tension of the bubble wall and the size of the bubble, bubbles of the same or similar wall material and of the same size have equal internal pressures, and form planar segments where they join. At the points where contact between any two bubbles is lost, the angles formed by the walls, on both the interiors of the two bubbles and on their common exterior, are all 120°. As a consequence, an array of equal sized bubbles 34 tightly packed upon a plane tends to take up a hexagonal structure, as illustrated in FIG. 6. By configuring the bubble generators 28 used to produce such an array in hexagonal relationship to each other, the motion of the bubbles in assuming such a structure on substrate 22 is minimized. The bottoms 100 of the bubbles in such a tight-packed array are substantially flat and hexagonal, and the bubbles are separated from each other by substantially flat vertical walls, 102 as illustrated in FIG. 7. It should be noted, however, that the polygons formed on substrate 22 by contacting bubbles 34 need not be hexagons, nor equilateral, nor indeed must the line of contact between bubbles be straight: equilateral hexagons are merely the limiting case for a tightly packed array of equal sized bubbles. By differently spacing the array of bubble generators 28, each bubble can be made to contact fewer than six other bubbles, and thereby assume more-or-less triangular, rectangular, or similar forms on substrate 22. Further variations can be made by altering the sizes of the individual bubbles.

Figure 5:
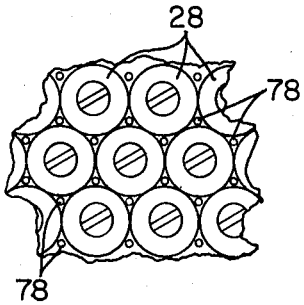
FIG. 5 is a fragmentary horizontal cross-sectional view of an array of bubble generators suitable for use in the practice of the invention, taken along the lines 5—5 of FIG. 1.
Figure 8:
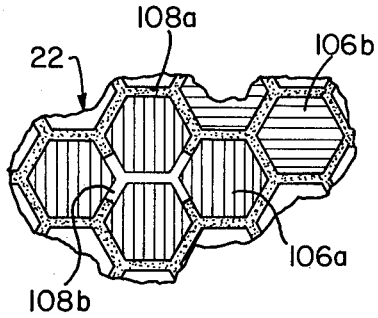
FIG. 8 is a representation of the printed image produced by the array of bubbles of FIG. 7.

The top surfaces of the bubbles remain upwardly convex spherical segments unless contacted by additional bubbles above them. Vertical walls 102 are double walls, and liquid may be transported by capillary action along the interstices between contacting bubbles. This allows sharply defined boundaries to be printed between contacting bubbles. Auxiliary feed tubes 78, located between bubble generators 28 as shown in FIG. 5, may be supplied small quantities of colored liquid, in the same way generators 28 are supplied, shortly after the array of bubbles 34 is formed. To this end, controller 50 supplies a third electrical pulse, directed to the metering pumps 48 associated with the auxiliary feed tubes 78, a short time interval after the signal directed to solenoid valve 54. This results in metering a small quantity of colored liquid in the form of drops of fluid 104 (as shown in FIG. 6), into the interstices of bubbles 34. Referring to FIGS. 7 and 8, it may be seen that, as fluid 104 flows by capillary action along the interstices between vertical walls 102 of adjacent bubbles 34, it forms, on contact with substrate 22, boundary line segments 108. If aliquots of fluid 104 are variously colored, as 104*a*, 104*b*, the corresponding boundry line segments 108*a*, 108*b* are accordingly colored.

Figure 7A:
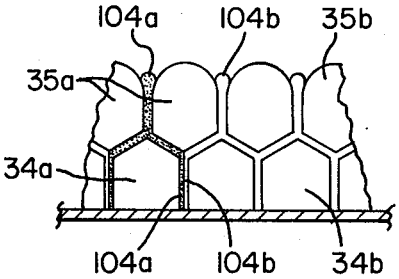
FIG. 7A is a vertical section view of an alternate array of bubbles formed by the apparatus of FIG. 1A.
Figure 8A:
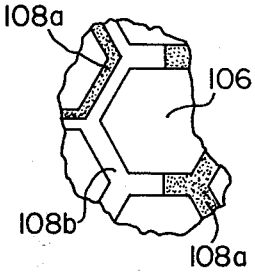
FIG. 8A is a representation of a portion of the printed image produced by the array of bubbles of FIG. 7A.

It should be appreciated that a second or third set of bubbles, produced by one or more additional arrays of generators 28 and auxiliary feed tubes 78, could also be used to the same end. Such a multiple array of bubbles may be formed by the apparatus illustrated in FIG. 1A. After the array of bubbles 34 is formed on substrate 22 by generators 28, it is carried under the array of generators 29 by the motion of the substrate. A signal from controller 50 to the solenoid valve 54 associated with generators 29, delayed after the signal releasing gas into bubbles 34 by the time required for substrate 22 to move between the two arrays of generators, produces the array of bubbles 35 above bubbles 34. As may be seen by reference to FIG. 7A, this secondary array of bubbles 35 may also have drops of fluid 104, supplied as by auxiliary feed tubes 78 associated with generators 29, dispensed at the interstices between the bubbles. In this case, bubbles 35 act to distribute, through capillary action, fluid 104 to the interstices of bubbles 34. By this means, a plurality of fluids, as fluids 104*a* and 104*b* may be simultaneously introduced into the same interstice, producing parallel adjacent boundary line segments 108*a*, 108*b* as shown in FIG. 8A.

It will be recognized that the array of bubbles 35 need not be composed of bubbles of the same size as bubbles 34. A single bubble 35 may be made large enough to cover a number of contiguous bubbles 34, thereby dispensing the same boundary line color to all the interstices of the group of contiguous bubbles 34 when bubbles 35 are the source of the boundary line color, or distributing color from fluid 104 to the interstices of bubbles 34 peripheral to the individual bubbles 35.

Substrate 22 is printed when coloring matter flows into the substrate from bubbles 34 and 35 and fluid 104. Areas 106 of FIG. 8 are printed with coloring matter from bubbles 34, made available to substrate 22 either through diffusion or through the deliberate collapse of the bubbles. Diffusion is governed by among other things, the ionic properties of the coloring matter, the wetting agent, if used, and the substrate. Printing of areas 106 may also be accomplished by the deliberate collapse of bubbles 34 by either mechanical means or by partial evaporation of the carrier fluid, as by radiant heater 44.

Boundary lines 108 of FIG. 8 are printed with coloring matter made available by fluid 104, or bubbles 35, or both, distributed to the substrate by capillary action through the interstices of bubbles 34 prior to the collapse of bubbles 34. In this connection, it will be understood that bubbles 35 may be collapsed, by mechanical means, prior to bubbles 34, in order that the coloring matter in the walls of bubbles 35 may be released to flow into the interstices between bubbles 34. If it is desired to print boundary lines 108 alone, leaving areas 106 uncolored, clear bubbles 34 are formed and overlaid by one or more arrays of colored bubbles 35 or drops of colored fluid 104. If colorless boundary lines 108 separating colored ares 106 are desired, bubbles 34 are colored and bubbles 35 or drops of fluid 104 are made colorless. It should also be noted that if a wetting agent is used, its rise, due to capillary action, into the interstices between adjacent bubbles 34 may inhibit the printing of a boundary line and provide separation between adjacent bubbles.

The ionic properties of the coloring agents used in bubbles 34 and 35 and in fluid 104 and of substrate 22 and the wetting agent, if any, must be considered not only from the standpoint of the rapidity with which color may be diffused into the substrate, but also with regard to whether colors from adjacent bubbles or fluids will mix or remain separated.

It will be appreciated from the discussion hereinabove that a number of factors and physical properties influence color flow. These factors are summarized in the following table, in which an asterisk indicates a relationship between the properties cited in row and column.

| | A | B | C | D | E | F | G | H | I | J | K | L | M | N | O |
|---|---|---|---|---|---|---|---|---|---|---|---|---|---|---|---|
| A-color(dye) | | * | | | * | * | * | * | | | | | * | * | * |
| B-bubble | * | | * | | | * | * | * | | | | * | * | * | * |
| C-no color | | * | | | | * | * | * | | * | | | | | |
| D-no bubble | | | | | | * | * | | | | | | | | |
| E-auxiliary color | * | | | | | * | * | * | * | | | | * | * | * |
| F-vertical order | * | * | * | * | | | * | * | | | | | | | |
| G-horizontal order | * | * | * | | | * | | * | | | | | | | |
| H-boundary walls | * | * | * | | | * | * | | | | | * | * | * | * |
| I-no boundary walls | | * | | | | | * | | | | | | | | |
| J-wet agent | | | * | | | | | | * | | * | | * | | |
| K-substrate | | | * | | | | * | * | | * | | * | * | * | |
| L-color block | | * | * | | * | * | * | * | | | | | * | * | * |
| M-non-ionic | * | * | | | * | | | * | | * | | | | | |
| N-anionic | * | * | | | * | | | * | | * | | | | | |
| O-cationic | * | * | | | * | | | * | | * | | * | | | |

A few examples may serve to illustrate the use of the table in the application of the principles of the present invention to the design of a printed pattern. From the first row of the table, one may note that color may be incorporated into bubbles 34 and into auxiliary color (bubbles 35 or fluid 104). The color may be distributed in a pattern with vertical order (i.e., in layers of bubbles 34 and 35 and drops of fluid 104), and, within each vertical layer, in a horizontally ordered pattern. The color may be distributed through boundary walls, and may be either non-ionized, anionic, or cationic. From the second row of the table, it may be noted that bubbles (34 and/or 35) may be either colored or uncolored, and may be arranged in vertical order (bubbles 35 above 34) as well as in horizontal order. Contiguous bubbles form boundary walls, through which auxiliary color may flow. The bubbles may also act as a color block, inhibiting the flow of color from a higher source to the substrate over the region covered by an individual bubble (as a large bubble 35 restricting the flow of fluid 104 to those interstices of bubbles 34 peripheral to bubble 35). The bubbles may be either non-ionic, anionic or cationic. Other related properties may be similarly established by use of the table. The absence of an asterisk indicates little or no relationship between the properties.

Bubbles 35 and 34 may be collapsed, sequentially or simultaneously, either by partial evaporation, as by radiant heater 44, or by mechanical means, such as an ultrasonic transducer. Sequential collapse of bubbles 35 before bubble 34 may be used when it is desired to release coloring matter from bubbles 35 to form boundary lines 108 and diffusion is not sufficiently rapid. The collapse of bubbles 34 releases the coloring matter contained in them and at the same time destroy the boundary walls, thereby ending control of the distribution of boundary line colors. Where printing from bubbles 34 has been accomplished by diffusion, or where clear bubbles 34 have been used to control the printing of boundary lines 108, bubbles 34 (and 35, if present) may be removed by bubble collapse means 36. Knife edge 90, being a maximum distance of about 1.5 mm above the substrate 22, separates the bubbles in an array from the substrate as the substrate moves under bottom wall 86. Successive bubbles 34 act to urge bubbles before them up and into trough 92. Contact with the electrically heated nichrome wires 94 bursts the bubbles, and the resulting released fluid 38 flows into trough 92, conduit 40 and reservoir 42 in order.

After printing, substrate 22 may be dried by radiant heater 46 before further processing. Alternatively, the substrate may be left wet or only partially dried before subsequent processing, such as overlay printing.

The present invention thus has various advantages. First, the array of different colored bubbles 34 provides a method for imprinting a multi-colored pattern or substrate 22 in a single operation, all bubbles contacting substrate 22 being formed simultaneously, rather than in a sequence of separate impressions. The practical problems associated with multiple impressions are therefore not of consequence with respect to the size of the palette of colors or the range of color intensities to be provided by solid colors. As the printing of boundary lines is positionally controlled by the array of bubbles contacting the substrate, registration of arrays of drops of colored fluid or additional layers of bubbles to provide boundary line color is not critical, and need only be controlled to within about one-third the diameter of an individual bubble in the array contacting the substrate, and not within a fraction of the width of the boundary.

The design to be printed may be simply changed by merely altering the control of the metering pumps, as by changing the settings on switches 52, rather than by preparing new stencils or plates. Finally, the substrate is imprinted with minimal contact force, inasmuch as the array of bubbles 34 are, in effect the printing plate.

It will be understood that the details and specific dimensions of the described embodiment are for the purpose of illustration only, and the invention is not to be construed as limited except by the scope of the appended claims.

What is claimed is:

1. A method of printing on a surface, said method comprising the steps of:

forming a plurality of first bubbles in selected sizes, selected ones of said bubbles comprising a fluid film containing a specified first colorant; said selected sizes being chosen such that said first bubbles are formed in abutting relationship with one another thereby forming first interstices of capillary dimensions between one another;

applying said first bubbles to said surface in a substantially ordered first array;

selectively depositing said first colorant on said surface from said selected bubbles in a pattern according to the distribution of said selected bubbles in said first array; and applying discrete portions of a second set of specific colorants in a substantially ordered second array above selected ones of said first interstices, thereby printing on said surface by capillary action a pattern of said second set of specific colorants arranged in accordance with the distribution of said selected first interstices.

2. The method of claim 1 wherein said second array comprises a plurality of second bubbles in selected second sizes, each of said second bubbles comprising a second fluid film containing a selected one of said second set of colorants, whereby said discrete portions of the second set of colorants are applied on said first interstices.

3. The method of claim 2 wherein said selected second sizes of selected ones of said second bubbles are chosen to be larger than said selected sizes of said first bubbles, whereby a single one of said second set of colorants may be simultaneously applied in a discrete portion above a plurality of contiguous said first interstices from a single one of said second bubbles.

4. The method of claim 1 wherein said second array comprises a plurality of second interstices of capillary dimensions formed by a set of second bubbles in abutting relationship to one another and to said first bubbles and further including the step of applying discrete portions of said second set of specific colorants in a substantially ordered third array above selected ones of said second interstices, thereby applying above said first interstices by capillary action discrete portions of said second set of specific colorants in accordance with the distribution of said selected second interstices.

5. The method of claim 1 further including the step of deliberately disrupting said fluid films of said first bubbles, thereby depositing said first colorant on said surface.

6. The method of claim 5 wherein said deliberate disruption of said fluid films is by partial evaporation.

7. A method of printing on a surface, said method comprising the steps of:

forming a plurality of first bubbles in abutting relationship with one another thereby forming first interstices of capillary dimensions between the fluid films of said first bubbles;

applying said first bubbles to said surface in a substantially ordered array; and applying discrete portions of specific colorants in a substantially ordered second array above selected said first interstices thereby printing on said surface by capillary action a pattern of said specific colorants arranged in accordance with the distribution of said selected first interstices.

8. The method of claim 7 wherein said second array comprises a plurality of second bubbles in selected sizes, each of said second bubbles comprising a second fluid film containing a selected one of said specific colorants whereby said discrete portion of said specific colorants are applied above selected said first interstices.

9. The method of claim 8 wherein said selected sizes of selected ones of said second bubbles are chosen such that said selected ones extend above a plurality of contiguous first interstices, applying thereto a selected one of said specific colorants from a single one of said second bubbles.

10. The method of claim 7 wherein said second array comprises a plurality of second interstices of capillary dimensions formed by a set of second bubbles in abutting relationship to one another and to said first bubbles and further including the step of applying discrete portions of said specific colorants in a substantially ordered third array above selected ones of said second interstices, thereby applying above said first interstices by capillary action said specific colorants in accordance with the distribution of said selected second interstices.

11. The method of claim 2 or 8 further including the step of deliberately disrupting said second fluid films of said second bubbles without disrupting said fluid films of said first bubbles, thereby applying the colorants contained in said second fluid films above selected first interstices of said first bubbles.

* * * * *